US006155734A

United States Patent [19]

Kageyama et al.

[11] Patent Number: 6,155,734

[45] Date of Patent: Dec. 5, 2000

[54] ROTARY STICK PROJECTING DEVICE

[75] Inventors: Hidehei Kageyama; Yoshio Noguchi; Sachio Arai, all of Kawagoe, Japan

[73] Assignee: Kotobuki Printing Co., Ltd., Japan

[21] Appl. No.: 09/384,205

[22] Filed: Aug. 27, 1999

[30] Foreign Application Priority Data

Aug. 27, 1998 [JP] Japan ..... 10-241373
Mar. 11, 1999 [JP] Japan ..... 11-064452

[51] Int. Cl.[7] ..... B43K 21/08

[52] U.S. Cl. ..... 401/75; 401/68; 401/32; 401/29; 401/116

[58] Field of Search ..... 401/68, 73, 75, 401/77, 78, 116, 143, 87; 461/32, 28

[56] References Cited

U.S. PATENT DOCUMENTS 3,771,881 11/1973 Swenson ..... 401/68
5,186,560 2/1993 Holloway ..... 401/87
5,813,421 9/1998 Wang ..... 401/68
5,829,901 11/1998 Brown et al. ..... 401/68

FOREIGN PATENT DOCUMENTS 1077075 3/1998 Japan .

*Primary Examiner*—David J. Walczak
*Attorney, Agent, or Firm*—Rothwell, Figg, Ernst & Manbeck

[57] ABSTRACT

A rotary stick projecting device comprises an inner barrel provided in its inner surface with helical grooves and on its outer surface with projections, a front barrel receiving a front part of the inner barrel so as to permit the inner barrel to turn relative to the front barrel, a rear barrel attached to the front barrel and provided on its inner surface with longitudinal projections which engage with the projections formed on the outer surface of the inner barrel to restrain the inner barrel from turning; and a slider having a front part provided with a stick holding part, and a rear part in engagement with the helical grooves of the inner barrel, capable of axial movement, and incapable of turning relative to the front barrel.

3 Claims, 14 Drawing Sheets

ROTARY STICK PROJECTING DEVICE

BACKGROUND OF THE INVENTION

1. Field of the Invention

The present invention relates to a rotary stick projecting device for projecting a stick, such as a stick-form cosmetic (a tube of lipstick, an eyebrow pencil or an eyeliner), an eraser or a color pencil lead, by a turning operation.

2. Description of the Related Art

A prior art rotary stick projecting device of this kind proposed in Japanese Patent Laid-open No. Hei 10-77075 comprises a front barrel, a rear barrel capable of being turned relative to the front barrel, and a stick holding member capable of holding a cartridge containing a stick, such as a stick-form cosmetic. The stick can be replaced with a new one without directly touching the stick by hand, such as a stick-form cosmetic.

Further a previously proposed twin-type rotary stick projecting device has a common barrel, and an internal stick projecting mechanism contained in the common barrel to projects sticks, such as eye color sticks, different from each other in material, color and thickness, alternately in opposite directions, respectively.

SUMMARY OF THE INVENTION

The prior art rotary stick projecting device is used mainly for projecting a stick having a truly circular section. When the rotary stick projecting device is operated to project the stick, a slider holding the stick is turned and advanced along a helical groove formed in the inner surface of a front barrel. Consequently, the stick turns as the same is advanced. In this prior art rotary stick projecting device, a holding part of the slider is in engagement with a helical groove formed in the inner surface of the front barrel capable of turning relative to a rear barrel through a slit formed in an inner barrel capable of turning together with the rear barrel. Therefore, the slider turns and advances relative to the front barrel when the front barrel or the rear barrel is turned.

A cosmetic for drawing a thin line, such as an eye liner, needs to be formed in a stick having an elliptic section. Since the elliptic section is directional, it is possible that the stick having an elliptic section is damaged by the inner surface of the front barrel when the prior art rotary stick projecting device is used for projecting the stick having an elliptic section because the stick is turned as the same is advanced. Furthermore, a large clearance is formed between the stick having an elliptic section and the inner surface of the front barrel and the stick is able t o rattle in the front barrel. Therefore, it is possible that the stick having an elliptic section is broken when the rotary stick projecting device containing the stick is dropped accidentally, and it is possible that parts of the rotary stick projecting device are broken when the barrel is turned forcibly through an angle exceeding an angle corresponding to the range of axial movement of the slider.

Accordingly, it is an object of the present invention to provide a rotary stick projecting device capable of holding and operating a cartridge of a stick, comprising a relatively small number of component parts, capable of being easily assembled, capable of advancing a stick without turning the same and of operating without trouble even if the stick is of an elliptic section suitable for drawing a thin line, forming a very small clearance between its component parts and the stick to prevent the stick from being broken when the rotary stick projecting device is dropped, capable of preventing its component parts from being broken by a forcible turning operation exceeding a limit, and capable of being easily and properly operated.

A problem arises in the known t rotary stick projecting device particularly when the stick is a thin one. When the rotary stick projecting device provided with a thin stick is dropped, the stick is liable to be broken at a part thereof held by the stick holding part of the rotary stick projecting device.

The known twin-type rotary stick projecting device is incapable of simultaneously projecting both the sticks because the sticks are not held individually by the internal stick projecting mechanism. When one of the sticks is projected, the other is retracted, and the projected stick is retracted when the other is projected because the two sticks are not held individually.

The present invention has been made to overcome those disadvantages and it is therefore an object of the present invention to provide a rotary stick projecting device provided with a slider having a stick holding part provided with a cushioning member to prevent the breakage of a stick held by the stick holding part by shocks that may be exerted thereon when the rotary stick projecting device is dropped.

Another object of the present invention is to provide a twin-type rotary stick projecting device having simple construction and provided with individual projecting mechanisms for individually projecting two sticks to enable the two sticks to be projected simultaneously.

According to one aspect of the present invention, a rotary stick projecting device comprises an inner barrel provided with a helical means in its inner surface and an engaging means on its outer surface; a front barrel receiving a front end part of the inner barrel and capable of being turned; a rear barrel detachably attached to the front barrel and provided on its inner surface with an engaging means which engages with the engaging means formed on the outer surface of the inner barrel to restrain the inner barrel from turning; and a slider having a front part provided with a stick holding part, and a rear part in engagement with the helical means of the inner barrel, capable of axial movement, and incapable of turning relative to the front barrel.

DETAILED DESCRIPTION OF THE PREFERRED EMBODIMENTS

A rotary stick projecting device in a preferred embodiment according to the present invention will be described hereinafter with reference to the accompanying drawings.

Figure 1:
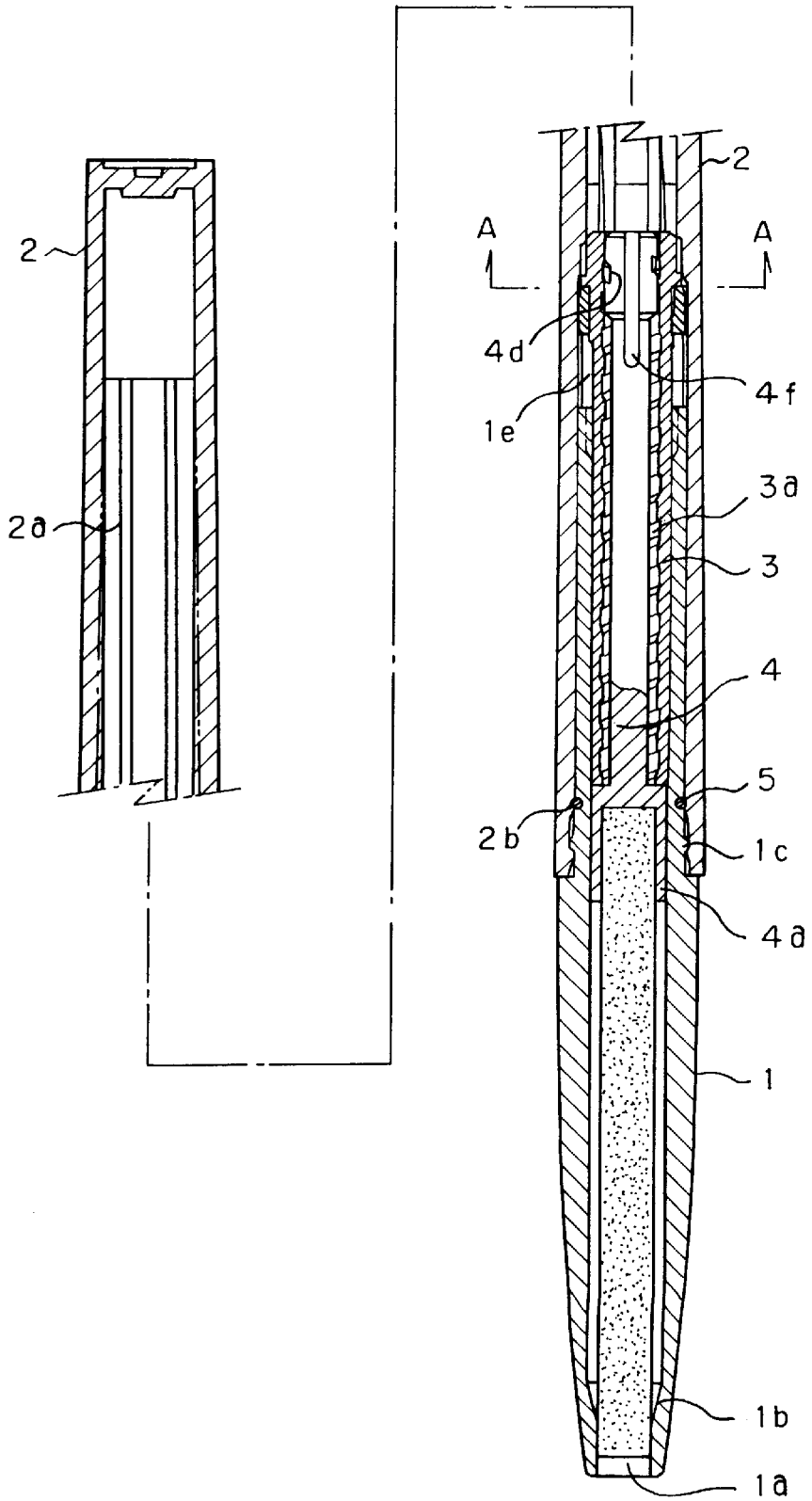
FIG. 1 is a longitudinal sectional view of a rotary stick projecting device in a preferred embodiment according to the present invention.

The rotary stick projecting device embodying the present invention will be described as applied to linearly projecting a stick-form cosmetic having an elliptic section, such as an eye liner, by a turning operation. Referring to FIG. 1, the rotary stick projecting device comprises a front barrel 1 provided with an opening la through which a stick is projected in its tip, and a bottomed rear barrel 2 combined with the front barrel 1 for turning relative to the front barrel 1. The rotary stick projecting device has a shape generally resembling a pencil.

Figure 2:
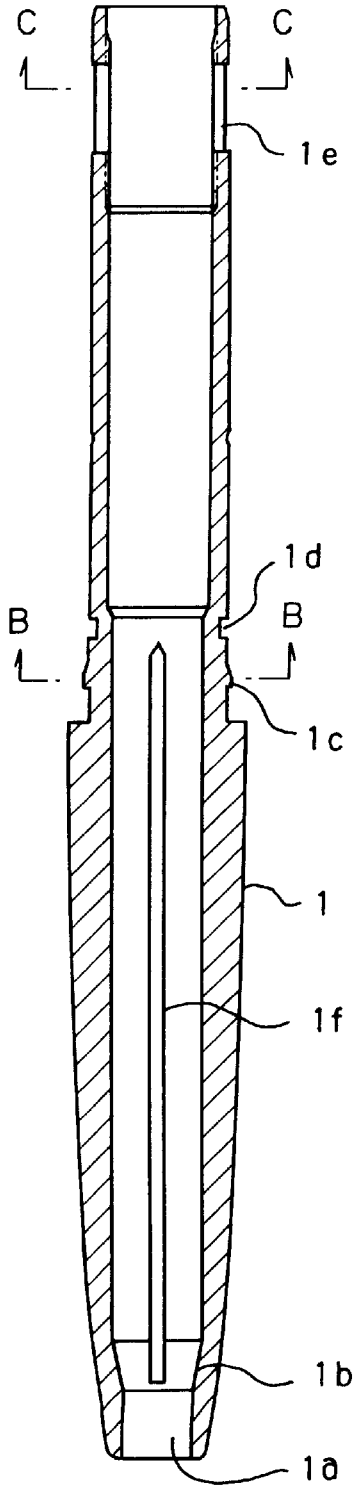
FIG. 2 is an enlarged longitudinal sectional view of a front barrel included in the rotary stick projecting device shown in FIG. 1.
Figure 3:
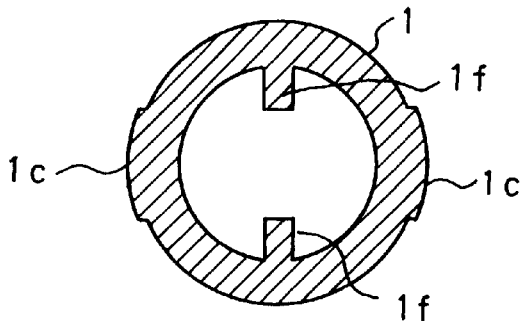
FIG. 3 is an enlarged sectional view taken on line B—B in FIG. 2.

As shown in FIG. 2, the front barrel 1 has a front end part tapered toward its tip provided with the opening 1*a*. A tapered guide part 1*b* is formed in the inner surface of the front end part. The tapered guide part 1*b* is spaced rearward from the opening 1*a*. A pair of outer ridges 1*c* (FIG. 3) are formed on the outer surface of a middle part of the front barrel 1 to hold the rear barrel 2 on the front barrel 1 so as to be easily separated from the front barrel 1 and to be turned relative to the front barrel 1. Since the front barrel 1 and the rear barrel 2 are in partial contact with each other along the outer ridges 1*c*, the front barrel 1 and the rear barrel 2 can easily be turned relative to each other and the rear barrel 2 can easily be put on and taken off the front barrel 1.

Figure 4:
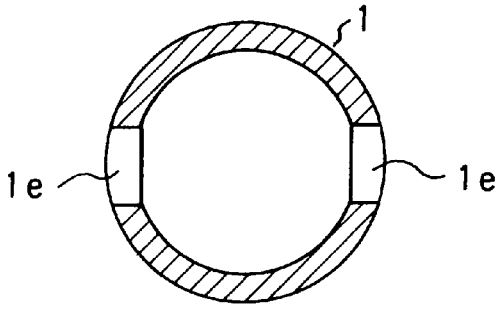
FIG. 4 is an enlarged sectional view taken on line C—C in FIG. 2.

An annular groove 1d for receiving an O ring 5 is formed in the outer surface of middle part of the front barrel 1 at a position slightly behind the outer ridges 1*c*. Openings 1*e* (FIG. 4) are formed in a rear end part of the front barrel 1 to facilitate assembling the front barrel 1 and the rear barrel 2. The openings 1*e* are spaced rearward from the annular groove 1*d*. Longitudinal guide ribs if (FIG. 3) are formed on the inner surface of a front part of the front barrel 1. The guide ribs 1*f* engage with slits 4*b* formed in a stick holding part 4*a* of a slider 4 to restrain the slider 4 from turning.

Figure 5:
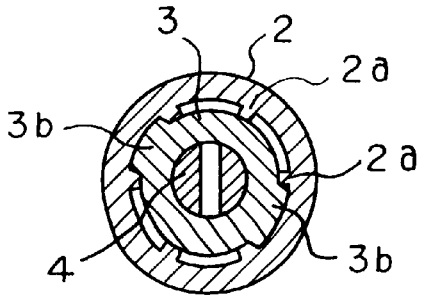
FIG. 5 is an enlarged sectional view taken on line A—A in FIG. 1.

The rear barrel 2 rotatably receiving a rear part of the front barrel 1 therein will be described hereinafter. Six longitudinal ribs 2*a* (FIG. 5) are formed on the inner surface of the rear barrel 2 at equal angular intervals. In view of facilitating work for assembling the rear barrel 2 and an inner barrel 3, it is desirable to form the ribs 2*a* in the least possible width sufficient to secure a sufficient strength for the ribs 2*a*.

Figure 6:
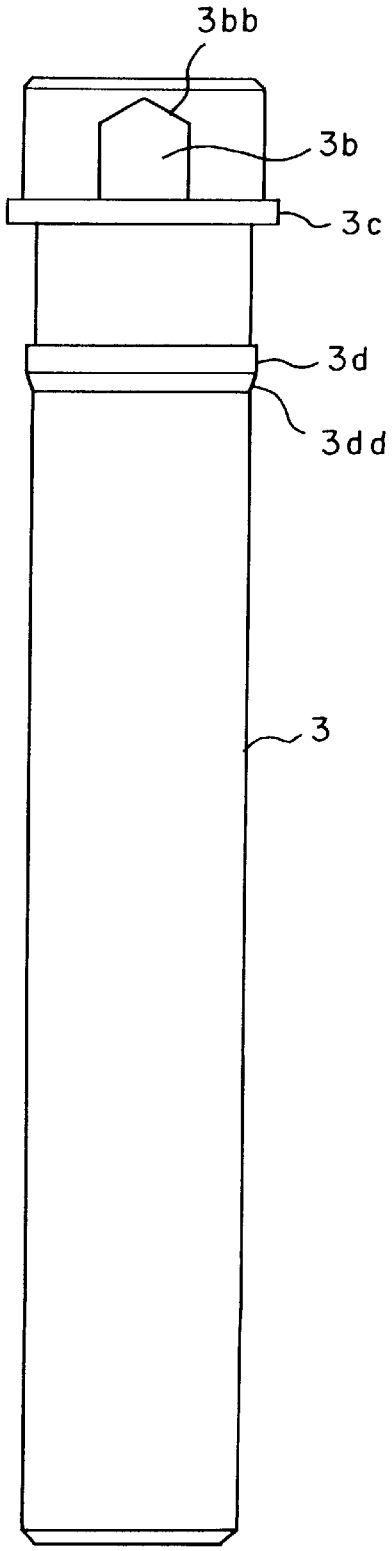
FIG. 6 is a front view of an inner barrel included in the rotary stick projecting device shown in FIG. 1.
Figure 7:
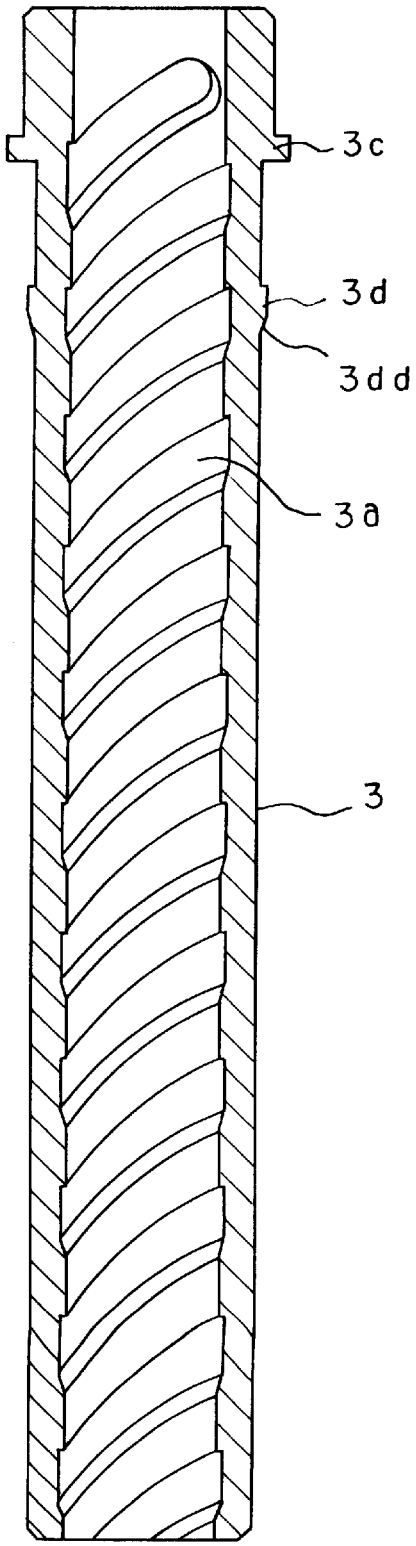
FIG. 7 is a longitudinal sectional view of the inner barrel shown in FIG. 6.
Figure 8:
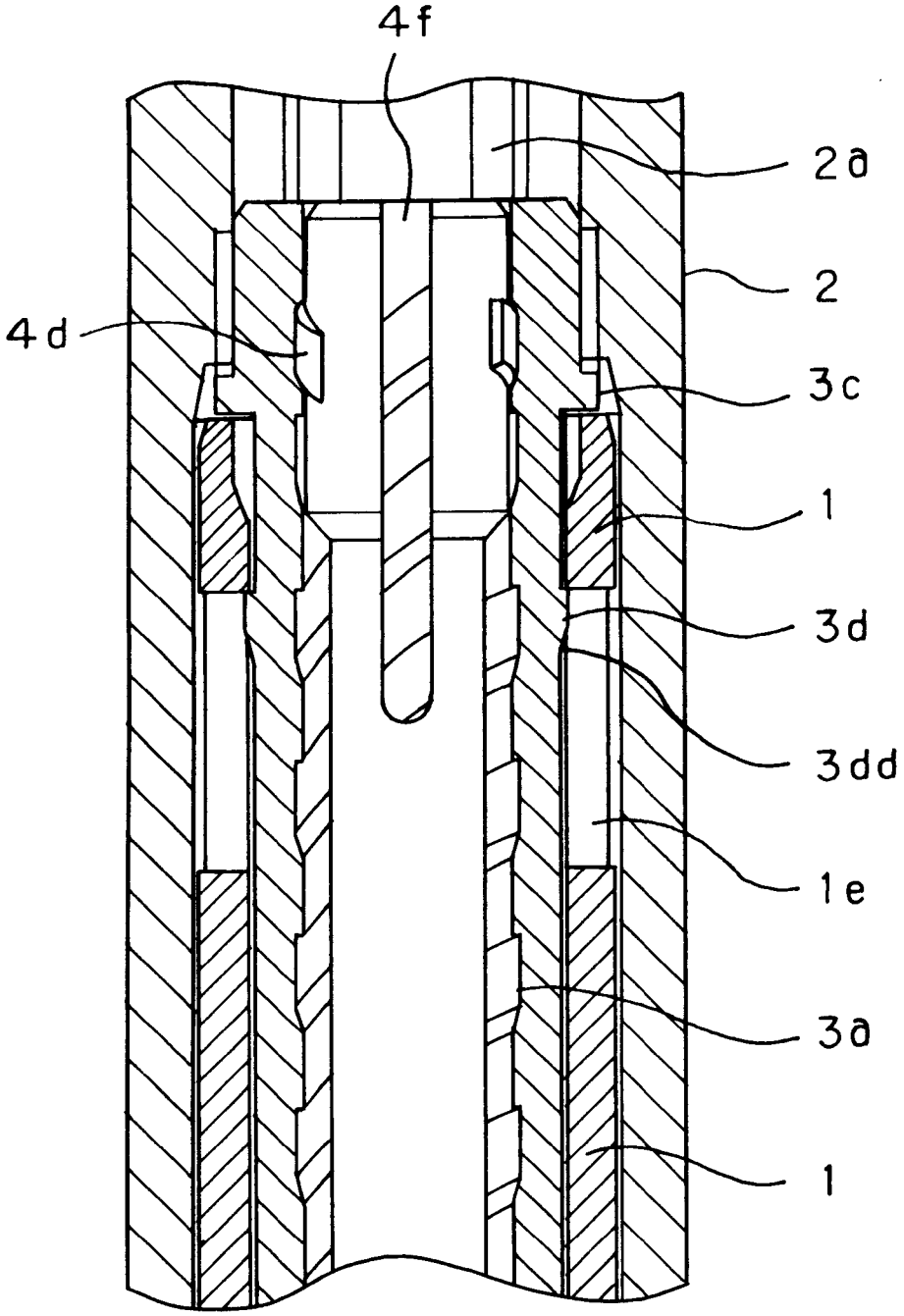
FIG. 8 is an enlarged longitudinal sectional view of an essential part of the rotary stick projecting device shown in FIG. 1.

Referring to FIGS. 6 to 8, the inner barrel 3 is inserted in a front end part of the rear barrel 2. A rear end part of the inner barrel 3 is engaged with the rear barrel 2 so that the inner barrel 3 is able to turn together with the rear barrel 2. A helical groove 3a (helical means) is formed in the inner surface of the inner barrel 3. A pair of projections 3*b* are formed on the outer surface of the rear end part of the inner barrel 3. The projections 3*b* engages with the ribs 2*a* to restrain the inner barrel 3 from turning. As shown in FIG. 6, each projection 3*b* has a triangular rear end 3*bb*. When the inner barrel 3 is inserted in the rear barrel 2, the triangular rear ends 3*bb* of the projections 3*b* guide the projections 3*b* into spaces between the six ribs 2*a* of the rear barrel 2.

An annular projection 3*c* is formed integrally with front end parts of the projections 3*b*. An annular stopper 3*d* is formed on the rear end part of the inner barrel 3 at a position spaced a predetermined distance forward from the annular projection 3*c*. A front part of the annular stopper 3*d* is tapered to form a bevel 3*dd*. As shown in FIG. 8, the annular projection 3*c* and the annular stopper 3*d* are formed so that a rear end part of the front barrel 1 behind the openings 1*e* extends between the annular projection 3*c* and the annular stopper 3*d*. When the front barrel 1 and the inner barrel 3 are assembled, a rear end part of the front barrel 1 behind the openings 1*e* extends between the annular projection 3*c* and the annular stopper 3*d*. Once the front barrel 1 and the inner barrel 3 are assembled, the inner barrel 3 cannot be separated from the front barrel 1 because the annular stopper 3*d* is in engagement with the rear edges of the openings 1*e*.

Figure 9:
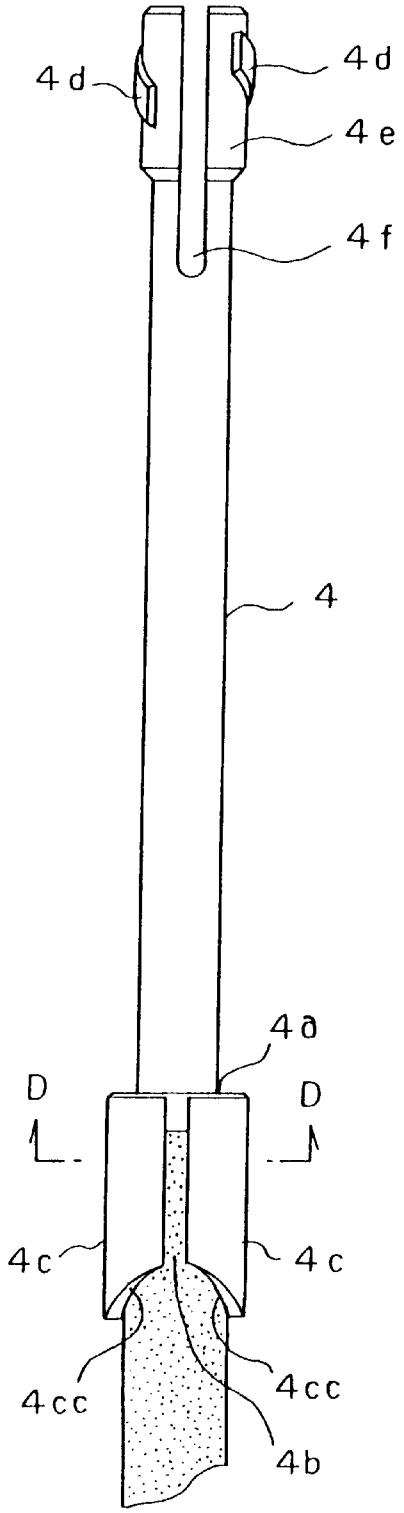
FIG. 9 is a front view of a slider included in the rotary stick projecting device shown in FIG. 1.
Figure 10:
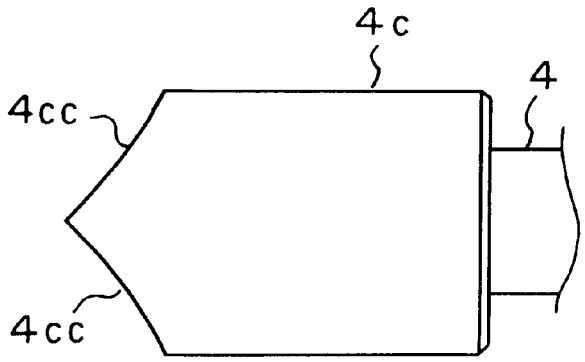
FIG. 10 is an enlarged view of a front end part of the slider shown in FIG. 9.
Figure 11:
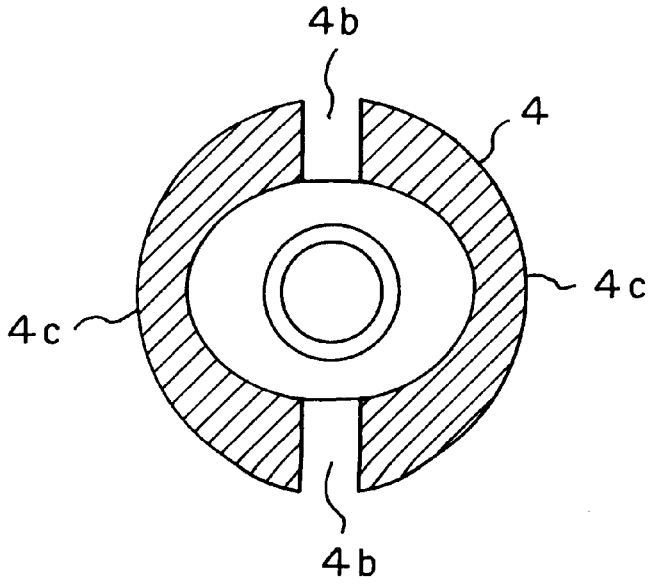
FIG. 11 is an enlarged longitudinal sectional view taken on line D—D in FIG. 9.

The slider 4 holding a stick having an elliptic section is inserted in the inner barrel 3 so as to slide in the inner barrel 3. Referring to FIGS. 9 to 11, the slider 4 is provided in its front part with the stick holding part 4*a* of a great diameter for holding the stick. The stick holding part 4*a* is provided in its outer wall with the pair of slits 4*b*, and a pair of stick holding tongues 4*c* separated by the slits 4*b*.

When the inner barrel 3 and the slider 4 are inserted in the front barrel 1, the guide ribs If of the front barrel 1 engages with the slits 4*b* to restrain the slider 4 from turning and to allow the slider 4 to move longitudinally. Each stick holding tongue 4*c* has a sharp part 4*cc* having thickness decreasing toward its extremity. When setting the slider 4 in the front barrel 1, the sharp parts 4*cc* guide the slits 4*b* to the guide ribs 1*f* of the front barrel 1 in order that the guide ribs 1*f* are able to engage easily with the slits 4*b*. When a lateral impact is applied to the front barrel 1, a space formed by the sharp parts 4*cc* in the stick holding part enables the stick to evade a lateral a force to prevent the breakage of the stick.

A pair of helical projections 4*d* capable of mating with the helical groove 3*a* of the inner barrel 3 are formed integrally with an engaging part 4*e* in a rear end part of the slider 4. When the slider 4 is set in the inner barrel 3 and the front barrel 1 or the rear barrel 2 is turned, the helical groove 3*a* of the inner barrel 3 drives the helical projections 4*d* to advance the slider 4. Since the guide ribs 1*f* of the front barrel 1 are in engagement with the slits 4*b* of the stick holding part 4*a* of the slider 4 to restrain the slider 4 from turning, the slider 4 is unable to turn and merely advances in the inner barrel 3.

A groove 4*f* is formed in the engaging part 4*e* of the slider 4 to split the engaging part 4*e* into opposite two sections. If the rear barrel 2 is turned forcibly with the slider 4 located at its upper position or its lower end position, the opposite two sections of the engaging part 4*e* are forced toward each other and, consequently, the inner barrel 3 turns ineffectively relative to the slider 4.

An O ring 5 shown in FIG. 1 is fitted in the annular groove 1*d* of the front barrel 1 to facilitate the assembly of the front barrel 1 and the rear barrel 2 and to enable the front barrel 1 and the rear barrel to turn smoothly relative to each other. The O ring is made of an elastic material, such as rubber.

A procedure for assembling the rotary stick projecting device will be described hereinafter for assistance in understanding the construction of the rotary stick projecting device. First, the slider 4 is inserted into the inner barrel 3 so that the helical projections 4*d* engage with the helical groove 3*a*. The assembly of the inner barrel 3 and the slider 4 is inserted into the front barrel 1. In this state, the triangular rear ends 3*bb* of the projections 3*b* of the inner barrel 3 guide the projections 3*b* into the spaces between the six ribs 2*a* of the rear barrel 2 when the triangular rear ends 3*bb* of the projections 3*b* are inserted in the rear barrel 2 when assembling the inner barrel 3 and the rear barrel 2.

When the front barrel 1 and the inner barrel 3 are assembled, the rear end part of the front barrel 1 behind the openings 1*e* extends between the annular projection 3*c* and the annular stopper 3*d* of the inner barrel 3. Once the front barrel 1 and the inner barrel 3 are thus assembled, the inner barrel 3 cannot be separated from the front barrel 1 because the annular stoppers 3*d* are in engagement with the rear edges of the openings 1*e*. The assembly of the inner barrel 3 and the slider 4 is pushed into the front barrel 1 properly so that the slits 4*b* formed in the stick holding part 4*a* of the slider 4 engage with the guide ribs 1*f* formed in the inner surface of the front barrel 1. Consequently, the slider 4 is able to turn together with the front barrel 1.

Subsequently, the O ring 5 is fitted in the annular groove 1*d* of the front barrel 1, and the rear barrel 2 is put on the front barrel 1 to complete the rotary stick projecting device. The work for providing the rotary stick projecting device with a stick is executed by the manufacturer in the factory and the user need not execute the work and hence any sanitary problem does not arise.

In operation, the rear barrel 2 of the rotary stick projecting device containing a stick is held by hand and the front barrel 1 is turned relative to the rear barrel 2. Then, the inner barrel 3 turns together with the rear barrel 2 relative to the front barrel 1 because the projections 3*b* of the inner barrel 3 are engaged with the ribs 2*a* of the rear barrel 2 to restrain the inner barrel 3 from turning relative to the rear barrel 2. Since the helical projections 4*d* of the slider 4 are engaged with the helical groove 3*a* of the inner barrel 3, and the slits 4*b* of the stick holding part 4*a* of the slider 4 are engaged with the guide ribs 1*f* formed in the inner surface of the front barrel 1, the slider 4 is advanced along the guide ribs 1*f*. Consequently, a part of the stick held by the slider 4 is projected for use through the opening 1*a* formed in the tip of the front barrel 1.

Since the groove 4*f* is formed in the engaging part 4*e* of the slider 4 to split the engaging part 4*e* into the opposite two sections, the opposite two sections of the engaging part 4*e* are forced toward each other if the front barrel 1 is turned excessively relative to the rear barrel 2 after the stick has been worn out and, consequently, the inner barrel 3 turns ineffectively relative to the slider 4 and the slider 4 is not advanced excessively. The stick held by the slider 4 can easily be retracted into the front barrel 1 by turning the front barrel 1 in the reverse direction relative to the rear barrel 2 after using the stick.

The front barrel 1, the inner barrel 3 and the slider 4 are assembled in a cartridge. Therefore the cartridge including the front barrel 1, the inner barrel 3 and the slider 4 holding the residual stick is removed from the rear barrel 2 after the stick has been depleted, and a new cartridge including a new front barrel 1, a new inner barrel 3 and a new slider 4 holding a new stick is combined with the rear barrel 2.

A front end part of the rear barrel 2 in engagement with the pair of outer ridges 1*c* can be disengaged from the ridges 1*c* of the front barrel 1 when the front barrel 1 and the rear barrel 2 are held by both hands and are pulled in opposite directions, respectively. Since the annular stopper 3*d* formed on the outer surface of the inner barrel 3 is engaged with the rear edges of the openings 1*e* formed in the side wall of the front barrel 1, the front barrel 1 will not be separated from the inner barrel 3 even if the front barrel 1 is pulled away from the rear barrel 2. Therefore, the cartridge including front barrel 1, the inner barrel 3 and the slider 4 holding the stick can be separated from the rear barrel, and a new cartridge containing a new stick can be combined with the rear barrel 2 without touching the new stick.

Figure 12:
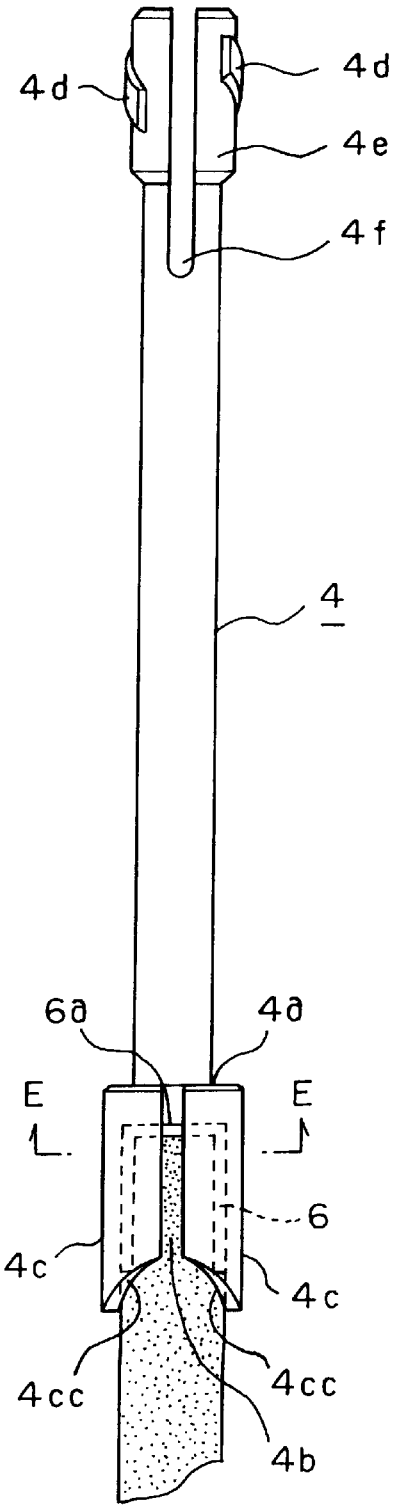
FIG. 12 is a front elevation of a slider included in a rotary stick projecting device in a second embodiment according to the present invention.
Figure 13:
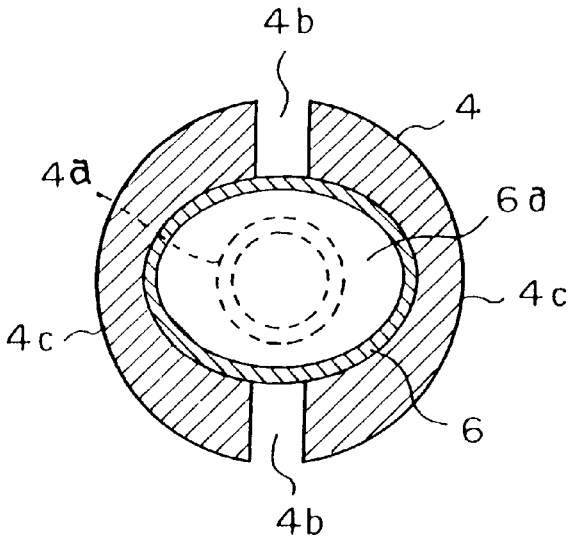
FIG. 13 is an enlarged sectional view taken on line E—E in FIG. 12.
Figure 14:
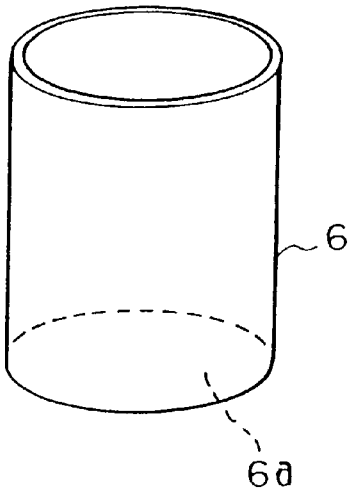
FIG. 14 is a perspective view of a cushioning member shown in FIG. 12.

FIGS. 12 to 14 show a slider 4 included in a rotary stick projecting device in a second embodiment according the present invention. The slider 4 is provided with a holding part 4*a* designed to absorb shocks to prevent a stick from being broken by shocks that may be exerted thereon when the rotary stick projecting device is dropped even if the stick is a thin one.

Referring to FIGS. 12 to 14, a cushioning member 6 made of an elastic material, such as rubber, and having the shape of a bottomed cylinder is fitted closely in the holding part 4*a* of the slider 4 by using a jig. A base part of a stick is fitted in the cushioning member 6. Since the cushioning member 6 is interposed between the holding part 4*a* of the slider 4 and the base part of the stick, shocks exerted on the slider 4 when the rotary stick projecting device is dropped are absorbed by the cushioning member 6, so that the breakage of the stick can be prevented even if the stick is a thin one. It is preferable to reduce the diameter of the base part of the stick taking into consideration the thickness of the side wall of the cushioning member 6 fitted in the holding part 4*a*.

Figure 15:
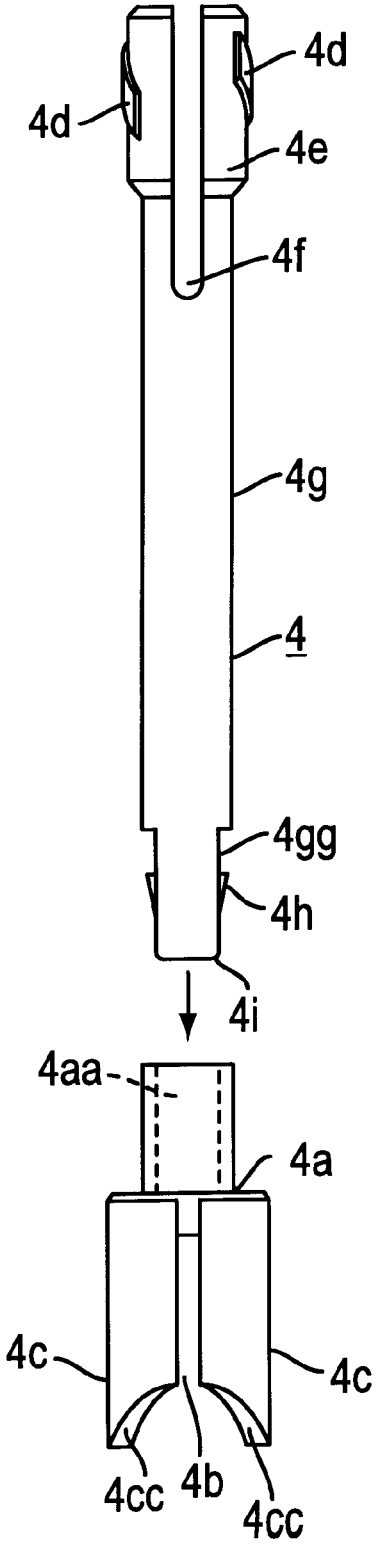
FIG. 15 is an exploded front elevation of a slider included in a rotary stick projecting device in a third embodiment according to the present invention.

FIG. 15 shows a slider 4 included in a rotary stick projecting device in a third embodiment according to the present invention in an exploded view. The slider 4 has a holding member 4*a* and a shaft member 4*g*. The holding member 4*a* and the shaft member 4*g* are separate members. The holding member 4*a* is made of an elastic material, such as a thermoplastic elastomer and is capable of functioning as a cushioning member. The shaft member 4*g* is formed by molding a synthetic resin, such as POM (polyacetal resin).

The holding member 4*a* has a rear part provided with a bore 4*aa*. The shaft member 4*g* has a reduced front end part 4*gg* provided with retaining ridges 4*h*. The edge of the tip of the shaft member 4*g* is chamfered in a bevel 4*i*. The bevel 4*i* facilitates the insertion of the front end part 4*gg* in the bore 4*aa* of the holding member 4*a*. The retaining ridges 4*h* makes the separation of the shaft member 4*g* from the holding member 4*a* impossible after the front end part 4*gg* has fully been inserted in the bore 4*aa*.

Figure 16:
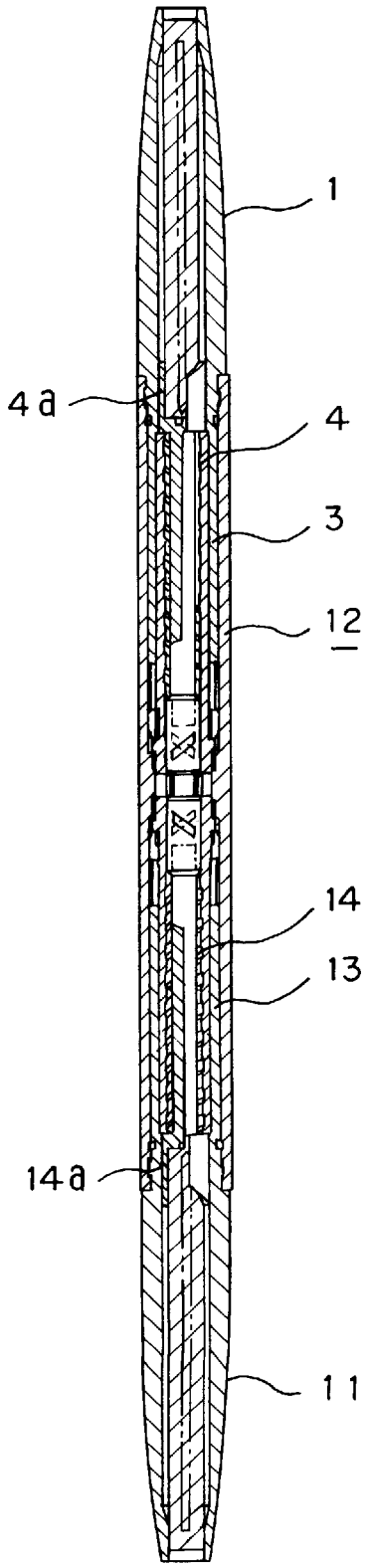
FIG. 16 is a fragmentary longitudinal sectional view with some parts omitted.

FIG. 16 shows a twin-type rotary stick projecting device in a fourth embodiment according to the present invention. The twin-type rotary stick projecting device is provided with a first stick projecting mechanism for axially moving a first stick, such as a black eye color stick, and a second stick projecting mechanism for axially moving a second stick, such as a brown eye color stick. The first and the second stick projecting mechanism are disposed in an upper and a lower part, as viewed in FIG. 16, of the twin-type rotary stick projecting device, respectively.

Figure 17:
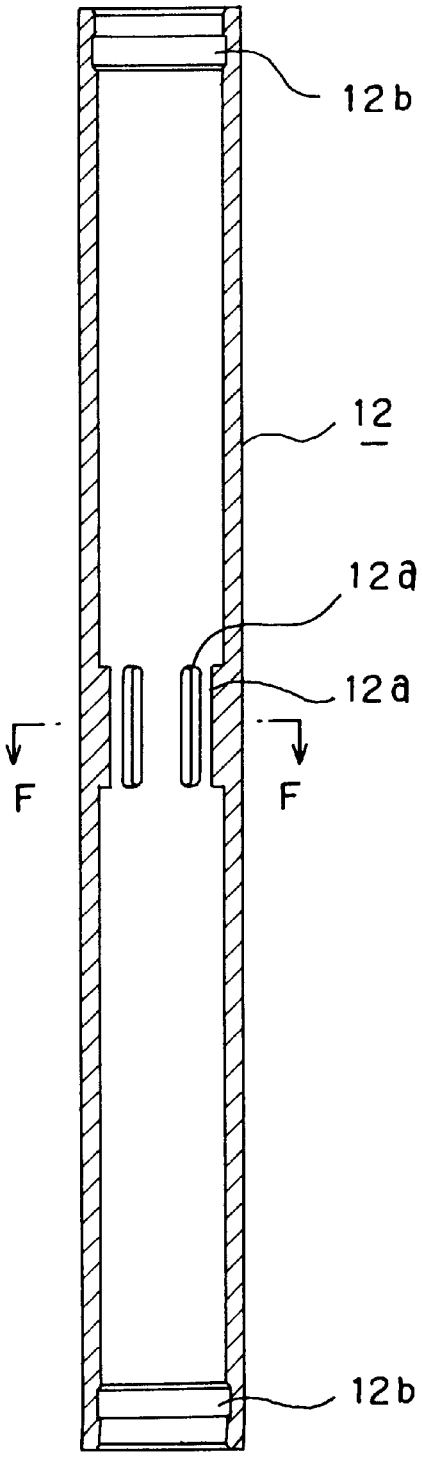
FIG. 17 is a longitudinal sectional view of a barrel shown in FIG. 16.
Figure 18:
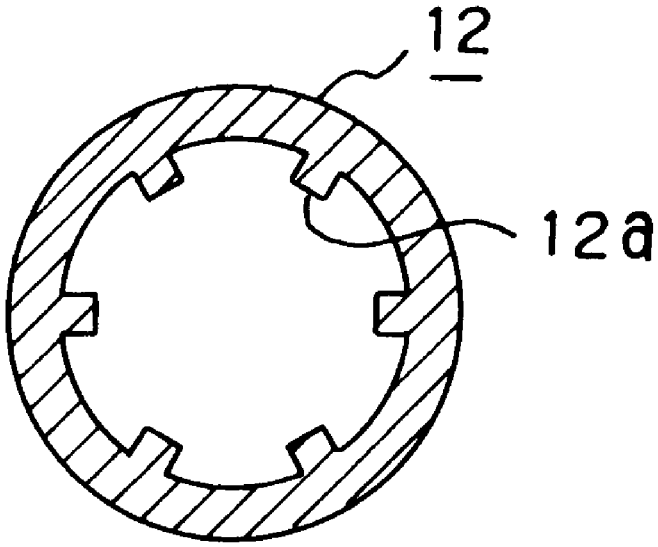
FIG. 18 is an enlarged sectional view taken on line F—F in FIG. 17.

The twin-type rotary stick projecting device is provided with a common barrel 12 as shown in FIG. 17. As shown in FIG. 18, the common barrel 12 is provided with six longitudinal ribs 12*a* on the inner surface of a middle part thereof. Rear end parts of a first inner barrel 3 and a second inner barrel 13 engage with the ribs 12*a* and are restrained from turning by the ribs 12*a*. Annular grooves 12*b* are formed in the inner surfaces of opposite end parts of the common barrel 12.

When using the twin-type rotary stick projecting device, a first front barrel 1 (a front barrel on the upper side as viewed in FIG. 16) is turned relative to the common barrel 12. Consequently, the holding part 4*a* of a first slider 4 holding the first stick is moved axially outward to project the first stick. The first slider 4 is restrained from rotation by the first inner barrel 3. Since the second stick is held by the second stick projecting mechanism independent of the first stick projecting mechanism holding the first stick, the second stick does not move at all.

If it is desired to project the second stick in a state where the first stick is projected, a second front barrel 11 is turned relative to the common barrel 12. Consequently, the holding part 14*a* of a second slider 14 holding the second stick is moved axially outward to project the second stick. Since the first and the second projecting mechanism are independent of each other, the first stick held by the holding part 4*a* of the first slider 4 is not retracted when the second stick held by the holding part 14*a* of the second slider 14 is projected.

As apparent from the foregoing description, the rotary stick projecting device in accordance with the present invention is suitable for projecting a stick having an elliptic section because the slider holding the stick moves linearly in the front barrel when the front barrel is turned relative to the rear barrel. The stick, such as a cosmetic stick, can be replaced with a new one without touching the new one because the stick can be contained in a cartridge. Since the clearance can be reduced to prevent rattling when a stick having an elliptic section is employed, there is no possibility that the stick is broken when the rotary stick projecting device is dropped and the stick can smoothly be projected.

The rotary stick projecting device can easily be assembled, the inner barrel turns ineffectively relative to the slider when the inner barrel is turned forcibly beyond a limit of turning, so that the component parts of the rotary stick projecting device will not be broken.

According to the present invention, the cushioning member is interposed between the stick and the holding part of the slider. Therefore, the cushioning member absorbs shocks exerted on the rotary stick projecting device when the rotary stick projecting device is dropped and hence the breakage of the stick can be prevented even if the stick is a thin one.

Furthermore, according to the present invention, the twin-type rotary stick projecting device has simple construction and is provided with the stick projecting mechanisms independent of each other. Therefore, the two sticks can simultaneously be kept projected to use both the two sticks.

What is claimed is:

1. A rotary stick projecting device comprising:

an inner barrel provided with a helical means in an inner surface thereof and an engaging means on an outer surface thereof;

a front barrel receiving a front end part of the inner barrel so as to permit the inner barrel to turn relative to the front barrel;

a rear barrel detachably attached to the front barrel and provided on an inner surface thereof with an engaging means which engages with the engaging means formed on the outer surface of the inner barrel to restrain the inner barrel from turning;

a slider having a front part provided with a stick holding part, and a rear part in engagement with the helical means of the inner barrel, capable of axial movement, and incapable of turning relative to the front barrel;

wherein the stick holding part of the slider is provided in a side surface thereof with longitudinal slits, and the front barrel is provided on an inner surface thereof with longitudinal guide ribs which engage with the longitudinal slits of the stick holding part of the slider, respectively; and the stick holding part of the slider has opposite stick holding tongues separated by the longitudinal slits, and each of the stick holding tongues has a sharp part having thickness decreasing toward an extremity thereof.

2. The rotary stick projecting device according to claim 1, wherein the rear barrel serves as a common barrel, a pair of sliders are contained in the common barrel in a back-to-back arrangement, and a pair of sticks can individually be projected from the common barrel.

3. The rotary stick projecting device according to claim 2, wherein the common barrel is provided with a plurality of ribs on the inner surface of a middle part thereof.

* * * * *